United States Patent [19]

Lane

[11] 4,165,953

[45] Aug. 28, 1979

[54] BLOWER ASSEMBLY

[75] Inventor: Lloyd L. Lane, Waterloo, Iowa

[73] Assignee: Deere & Company, Moline, Ill.

[21] Appl. No.: 843,074

[22] Filed: Oct. 17, 1977

[51] Int. Cl.[2] ..... F04B 17/00

[52] U.S. Cl. ..... 417/350; 417/363; 417/370

[58] Field of Search ..... 417/350, 369, 423 R, 417/363, 370

[56] References Cited

U.S. PATENT DOCUMENTS

| | | | |
|---|---|---|---|
| 1,906,533 | 5/1933 | Burke | 417/350 |
| 2,112,277 | 3/1938 | Euwer | 417/350 X |
| 2,337,325 | 12/1943 | Hach et al. | 417/350 X |
| 2,390,509 | 12/1945 | Carter | 417/350 X |
| 3,199,774 | 8/1965 | Lowell | 417/363 X |
| 3,296,824 | 1/1967 | Rohrs et al. | 417/350 X |
| 3,390,401 | 6/1968 | Matsuyoshi et al. | 417/350 |
| 3,469,772 | 9/1969 | McDonald | 417/350 |
| 3,874,191 | 4/1975 | Hudson | 417/423 R |

FOREIGN PATENT DOCUMENTS

| | | | |
|---|---|---|---|
| 909902 | 5/1946 | France | 417/350 |

*Primary Examiner*—Carlton R. Croyle
*Assistant Examiner*—Leonard E. Smith

[57] ABSTRACT

A blower assembly includes an electric ventilated motor having a through output shaft with a blower wheel attached at each end. The motor, encircled by a pair of rubber O-rings with the blower wheels attached, is inserted in a blower housing assembly which is split along a horizontal line parallel to the motor output shaft which divides the housing assembly into an upper and lower housing. The housing assembly contains a central cavity for enclosing the motor and a cavity to either side of the central cavity for enclosing the blower wheels. The motor proximate and distal walls of the blower wheel cavities contain inlets to allow air to be drawn in by the blower wheels and the blower wheel cavities in the lower housing contain air outlets for the air to be blown out. The lower housing further contains air passages from the air outlets, to one end of the motor cavity to provide pressurized air to the motor. With the O-rings blocking passage of air between the motor and the housing, air is forced through the ventilated motor to cool the motor and exits through a motor exhaust in the upper housing proximate one of the inlets to the blower wheel cavity.

8 Claims, 5 Drawing Figures

BLOWER ASSEMBLY

BACKGROUND OF THE INVENTION

The present invention relates generally to air blower assemblies and more particularly to an air blower assembly having a simple two-piece blower housing.

In the past, blower housing assemblies were made up of a large number of complex parts through different processes as shown in U.S. Pat. Nos. 2,776,088 and 3,780,411. A large number of die sets were required to form the various components and a great deal of assembly time was required to assemble the final blower assembly.

Further, because most of the blower motors were operating in dusty environments, expensive hermetically sealed motors were required and this in turn resulted in short motor lives because of the inability of such motors to eliminate heat when operating at high speeds.

Still further, because of the multitude of parts and complex assembly required, servicing of the blower assembly was generally time consuming and expensive.

SUMMARY OF THE INVENTION

The present invention provides a simple, inexpensive blower housing assembly which encloses the motor and the blower wheels.

The present invention further provides filtered cooling air to the blower motor which can now be a less expensive ventilated motor. By taking air from one of the blower outlets perpendicular to the outlet flow, it is possible to provide air with a minimum of heavy contaminants which minimizes the clogging of the air filter and thus the need for filter cleaning.

The present invention further provides for forced air cooling of the ventilated motor by taking air from the outlet which is under pressure and forcing it through the motor and out of the motor near one of the air inlets where there is a reduced pressure to draw the air out of the motor. This forced air cooling allows operation of the blower motor at 150° F. as contrasted to the prior art motors which operated at temperatures around 310° F.

The present invention further provides a simple noise and vibration isolation mounting for the blower motor.

The above and additional advantages of the present invention will become apparent to those skilled in the art from a reading of the following detailed description when taken in conjunction with the accompanying drawings.

DESCRIPTION OF THE PREFERRED EMBODIMENT

Figure 1:
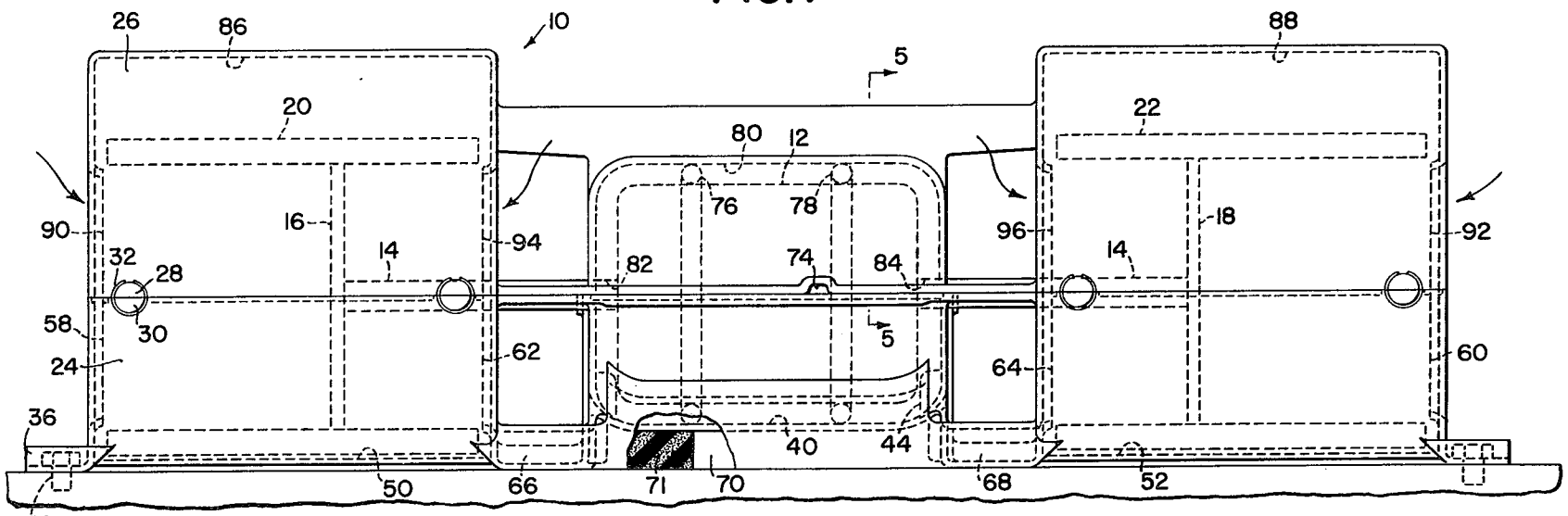
FIG. 1 is a front view partially in section of the present invention.
Figure 2:
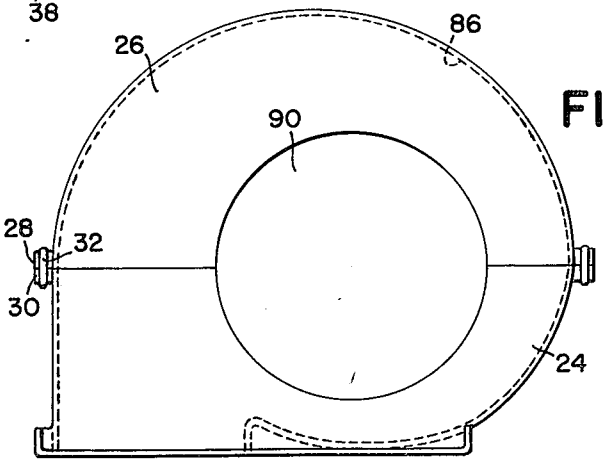
FIG. 2 is a side view of the present invention.

Referring now to FIGS. 1 and 2, therein is shown a blower assembly which includes a blower housing assembly 10 which contains a conventional ventilated motor 12 having a through output shaft 14 with first and second blower wheels 16 and 18 secured to the ends thereof. The first and second blower wheels 16 and 18 include a plurality of fan blades 20 and 22, respectively, for moving air through the blower assembly.

The blower housing assembly 10 is split along a horizontal plane through the output shaft 14 into a lower and upper housing 24 and 26, respectively. As seen in FIG. 2, the lower and upper housings 24 and 26 includes stud portions 28 and 30, respectively, which are encircled by compression rings 32 which hold the blower housing assembly 10 together. By reference to FIG. 3, it may be seen that the blower housing assembly 10 is further held together by screws (not shown) which pass through the motor securing holes 34. The blower housing assembly 10 is secured to a base structure by a flange 36 on the lower housing 24 and bolts 38.

Figure 3:
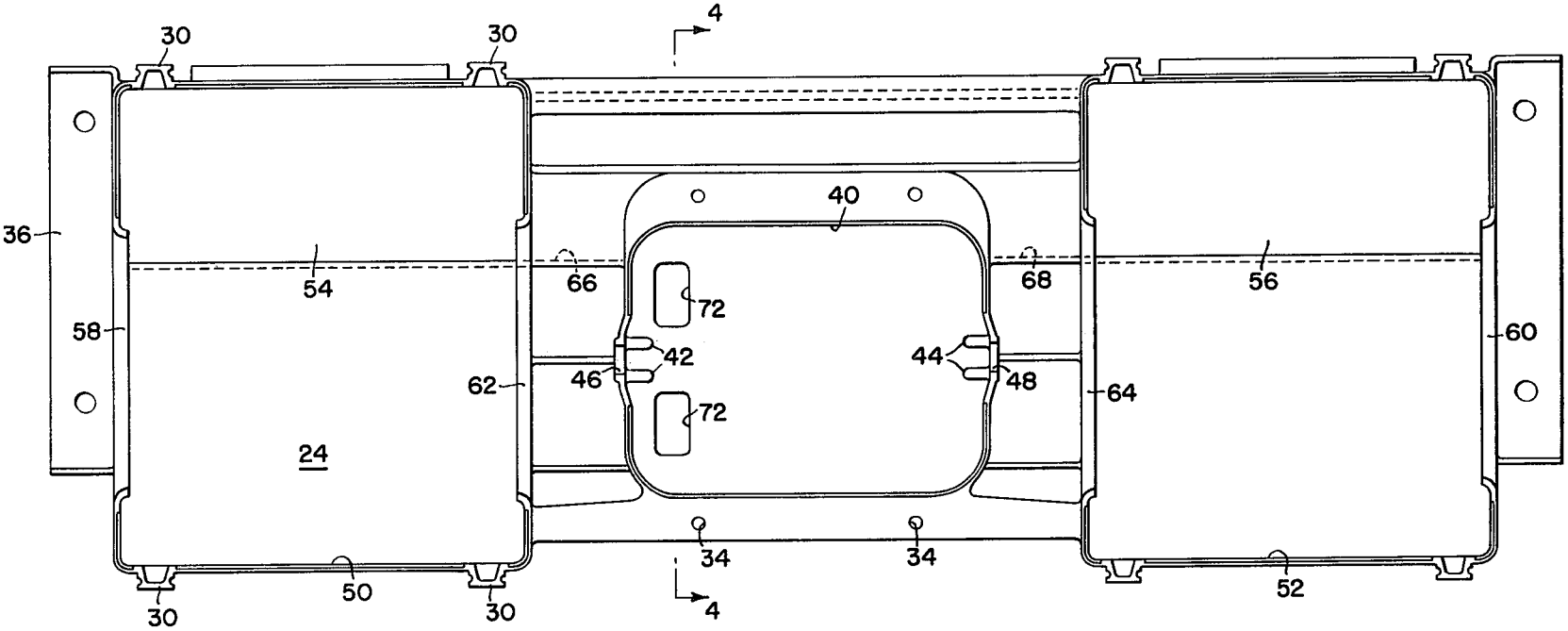
FIG. 3 is a top view of a portion of the present invention.

As seen in FIG. 3, the lower housing 24 contains a semi-cylindrical lower motor cavity 40. At opposite ends of the lower motor cavity 40 are two pairs of nut tabs 42 and 44 which engage protruding nuts (not shown) on the motor 12 so as to prevent the motor from turning while it is in operation. Proximate the nut tabs 42 and 44 are output shaft openings 46 and 48 which partially encircle the output shaft 14. To one side of the lower motor cavity 40 is a first lower blower wheel cavity 50 and on the other side is a second lower blower wheel cavity 52 which partially enclose the first and second blower wheels 16 and 18, respectively. Although the outlets for the blower assembly may be placed at any location around the blower housing assembly 10, in the preferred embodiment first and second outlets 54 and 56 open from the bottom of the first and second lower blower wheel cavities 50 and 52, respectively.

At opposite ends of the lower housing 24 are first and second lower air inlets 58 and 60, respectively, which open into the first and second lower blower wheel cavities 50 and 52, respectively. Proximate the lower motor cavity 40, are third and fourth lower air inlets 62 and 64 which also open into the first and second lower blower wheel cavities 50 and 52, respectively.

Integrally placed in the lower housing 24 are a pair of air passages 66 and 68 which connect the bottom of the first and second lower blower wheel cavities 50 and 52, respectively, to an air passage 70 below the lower motor cavity 40.

Figure 4:
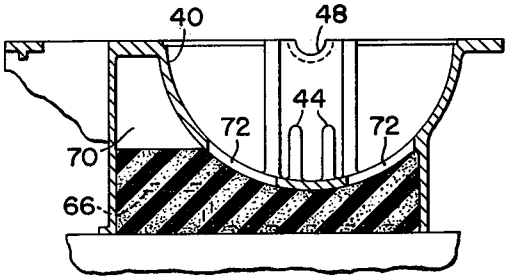
FIG. 4 is a cross-sectional view taken along the line 4—4 of FIG. 3.

A filter 71 is disposed in the air passage 70. This filter 71 may be any open cell polyurethane foam which will allow the passage of air with a minimum of restriction while entrapping contaminants in the air. As seen in FIGS. 3 and 4, the bottom of the lower motor cavity 40 at one end has a pair of motor intake openings 72 which connect to the air passage 70. In FIG. 1, therein is shown a wire way 74 through which the electrical wires to the motor 12 pass.

During assembly of the blower assembly, the motor 12 encircled by a pair of rubber O-rings 76 and 78 is inserted in the lower motor cavity 40 with the first and second blower wheels 16 and 18 respectively fitting into the first and second lower blower wheel cavities 50 and 52, respectively.

The upper housing 26 which fits over the lower housing 24 includes a centrally located semi-cylindrical upper motor cavity 80 having output shaft openings 82 and 84 at opposite ends thereof. At opposite ends of the upper motor cavity 80 are first and second upper blower wheel cavities 86 and 88 which cover the first and second blower wheels 16 and 18, respectively.

At opposite ends of the upper housing 26 are first and second upper air inlets 90 and 92 which are contiguous with the first and second lower air inlets 58 and 60 in lower housing 24. Proximate the upper motor cavity 80 opening respectively into the first and second upper blower wheel cavities 86 and 88 are third and fourth upper air inlets 94 and 96 which are contiguous with the third and fourth lower air inlets 62 and 64.

Figure 5:
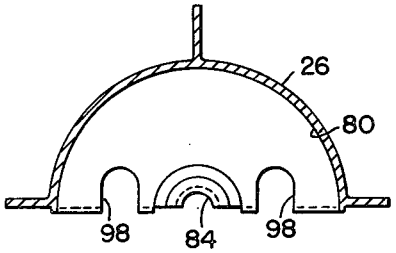
FIG. 5 is a cross-sectional view of a portion of FIG. 1 taken along the line 5—5.

Opening from the upper motor cavity 80 into the area of the fourth upper air inlet opening 96 are a pair of motor exhaust openings 98 which is on the opposite end of the upper housing 26 from the motor intake openings 72 in the lower housing 24. The motor exhaust openings 98 may best be seen in FIG. 5.

In operation, as the motor 12 drives the first and second blower wheels 16 and 18, air is drawn in through the first through fourth lower and upper air inlets 58, 60, 62, 64, 90, 92, 94, and 96 and then blown out through the first and second outlets 54 and 56. As the air exits the first and second outlets 54 and 56, it is under a slight pressure which forces air into the air passages 66 and 68. Due to the speed of the air blowing by the air passages 66 and 68, the majority of contaminants in the air are flung past the passages. Relatively clean air enters the filter 72 which cleans the air of the contaminants and allows the air to enter the blower motor cavity 40 through the motor intakes 72.

Since the ventilated motor 12 is circumferentially isolated from the lower and upper motor cavities 40 and 80 by the O-rings 76 and 78 and also since these O-rings prevent the passage of air from one end of the motor 12 to the other, air is forced through the motor 12 for cooling and reaches the area proximate the motor exhaust openings 98. Since the motor exhaust opening 98 is close to the fourth lower and upper air inlets 64 and 96, the low pressure thereat draws heated air out of the motor exhaust openings 98.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

I claim:

1. In an air blower assembly including a ventilated motor having an axially extending output shaft and a blower wheel connected to the output shaft, a blower housing assembly comprising: a lower housing having a lower motor cavity provided therein open to the top for insertion of the motor and open to one side thereof for extension of the output shaft from the lower motor cavity, said lower housing having a lower blower wheel cavity provided therein to the one side of the lower motor cavity and open to the top for insertion of the blower wheel axially in line with the output shaft, said lower housing having a first lower air inlet opening into the lower blower wheel cavity proximate the one side of the lower motor cavity, a second lower air inlet opening into the lower blower wheel cavity distal from the one side of the lower motor cavity, and an air outlet opening from the bottom of the lower blower wheel cavity to the bottom of the lower housing, and an air passage provided therein connecting the air outlet opening to the lower motor cavity opposite the one side thereof; an upper housing having an upper motor cavity provided therein open to the bottom for contiguous positioning with the lower motor cavity in the lower housing to enclose the motor and open to one side thereof for extension of the output shaft from the upper motor cavity, said upper housing having an upper blower wheel cavity provided therein to the one side of the upper motor cavity and open to the bottom for contiguous positioning with the lower blower wheel cavity in the lower housing to enclose the blower wheel, said upper housing having a first upper air inlet opening into the upper blower wheel cavity proximate the one side of the upper motor cavity for contiguous positioning with the first lower air inlet in the lower housing and having a second upper air inlet opening into the upper blower wheel cavity distal from the one side of the upper motor cavity for contiguous positioning with the second lower air inlet in the lower housing; means to secure the upper and lower housings together; means contacting the upper and lower housings when secured together for blocking the passage of air between the motor and housings from the output shaft opening proximate sides to the output shaft opening distal sides of the upper and lower housings when the motor is inserted; and the upper housing includes motor exhaust openings provided in the one side of the motor cavity whereby air from the outlet opening of the lower blower wheel cavity is forced and drawn through the air passage and through and from the motor and passes out said exhaust openings into the first air inlets into the upper and lower housings.

2. The blower assembly as claimed in claim 1 wherein the means for blocking the passage of air defines means for vibration isolating the motor from the upper and lower housings.

3. The blower housing assembly as claimed in claim 1 including means in the lower housing to prevent the motor from turning during operation.

4. The blower housing assembly as claimed in claim 1 including filter means disposed in the air passage for filtering air from the air outlet to the lower motor cavity.

5. A blower assembly comprising: a ventilated motor; a through output shaft in said motor; first and second blower wheels fixed to the ends of the output shaft; a lower motor cavity provided therein enclosing a portion of the motor and having openings axially in line with the output shaft for extension of the ends of said shaft from the lower motor cavity, said lower housing having first and second blower wheel cavities provided therein on either side of the motor cavity axially in line with the output shaft and enclosing respective portions of the first and second blower wheels, and first and second air inlet openings provided in said housing open respectively to the first and second blower wheel cavities and distally located from the motor cavity, said lower housing having first and second air outlet openings provided therein respectively open to the first and second blower wheel cavities; said lower housing further having first and second air passages provided therein respectively connecting the first and second air outlet openings to one end of the lower motor cavity; an upper housing having a motor cavity provided therein contiguous with the lower motor cavity in the lower housing and enclosing the remaining portion of the motor and having openings axially in line with the output shaft for extension of said shaft from the motor cavity, said upper housing having first and second blower wheel cavities provided therein on either side of the motor cavity axially in line with the output shaft and respectively contiguous with the first and second blower wheel cavities in the lower housing and respectively enclosing the remaining portions of the first and second blower wheels, said upper housing having first and second air inlet openings provided therein respectively contiguous with the first and second air inlet openings in the lower housing and distally located from the upper motor cavity; means for securing the upper and lower housings together; and means encircling the motor and blocking the passage of air from the one end of the upper and lower motor cavities to the other end of the upper and lower motor cavities and wherein the upper housing includes means for receiving air passed through said ventilated motor from said first and second air passages and for directing air from the other end of the upper motor cavity to the second upper blower wheel cavity.

6. The blower assembly as claimed in claim 5 wherein the means encircling the motor defines means for vibration isolating the motor from the upper and lower housings.

7. The blower assembly as claimed in claim 5 including means in the lower housing engaging the protrusions on the motor to prevent the motor from turning during operation.

8. The blower assembly as claimed in claim 5 including filter means disposed in the first and second air passages for filtering air from the first and second air passages to the lower motor cavity.

* * * * *